United States Patent [19]

Trumbauer et al.

[11] Patent Number: 4,844,141

[45] Date of Patent: Jul. 4, 1989

[54] CORE DEFINING APPARATUS AND METHOD

[75] Inventors: David V. Trumbauer, Denver; Alan E. Seeley, Waterloo, both of Iowa

[73] Assignee: Deere & Company, Moline, Ill.

[21] Appl. No.: 12,413

[22] Filed: Feb. 9, 1987

[51] Int. Cl.[4] ..... B22C 9/10; B22C 13/12

[52] U.S. Cl. ..... 164/15; 164/28; 164/186; 164/228; 164/262

[58] Field of Search ..... 164/228, 186, 701, 262, 164/28, 15

[56] References Cited

U.S. PATENT DOCUMENTS 1,735,890 11/1929 Brune .
2,806,265 9/1957 Jackson .
2,929,120 3/1960 Brandt et al. .
2,937,421 5/1960 Taccone .

FOREIGN PATENT DOCUMENTS 2847841 5/1979 Fed. Rep. of Germany ..... 164/228

*Primary Examiner*—Kuang Y. Lin

[57] ABSTRACT

A core machine is arranged to automatically refine the shape of a sand core upon removal of the core from the machine. The core machine uses a core box to form a core. After formation of the core and separation of the core box halves a shaping member is moved into a space between the core box halves. As the core is ejected from the core box and removed from the machine it passes through the shaping member which refines the shape of the core. The machine may also be used for dimensional tolerancing about the parting line of the core box.

10 Claims, 1 Drawing Sheet

CORE DEFINING APPARATUS AND METHOD

BACKGROUND OF THE INVENTION

1. Field of the Invention

This invention relates generally to the forming of sand cores for casting operations. More specifically, this invention relates to a method and apparatus for forming and shaping sand cores.

2. Description of the Prior Art

The use of cores to form the shape of cast products or molds is well known. Forming methods are known to provide cores with complicated geometries. Such cores are usually formed in a core box composed of corresponding halves which are joined together about a common seam or parting line to define a cavity having the finished or semi-finished shape of the core. The core is formed by introducing a core forming medium, typically sand, into the cavity and a suitable bonding agent which is thermally or catalytically reacted subsequent to its introduction so that the bonding agent will cause the core forming medium to retain the shape of the cavity. After the core has cured, the core box halves are separated and the core is removed. Since each core is typically used in a single casting, it is important to minimize the cost of producing cores.

Before a core is ready to be used in a casting, its shape must meet predetermined tolerances. Obtaining tolerances may require adjustment of the as formed core shape. Such adjustment may include major reshaping or merely removal of irregularities.

The two piece core box operation almost invariably leaves a fin of sand extending about the core at the location of the core box parting line or seam. Consequently, for most core box operations the shape adjustment includes at least a definning step. The definning operation is costly since the usual procedure is to take the core from the core box to a remote station and there remove the fin. Taking the cores from the core forming apparatus to a separate station is inefficient and raises the cost of forming finished cores.

Various methods are known for removing fins from sand cores. U.S. Pat. No. 2,929,120 shows the use of a low pressure jet to blast sand fins from formed cores. Another known method for definning is to manually pass a die or defining plate, having an outline of the finished core, over the periphery of the core and shear off the sand fin. It is also known to use dies in the more extensive shaping of rough formed sand cores. U.S. Pat. No. 1,735,890 shows an apparatus for defining an extruded shape of a core wherein a rough formed core is loaded into the apparatus and passed through a die having the desired shape. U.S. Pat. No. 2,937,421 shows an apparatus that combines the steps of forming a rough core and passing the rough core shape through a finishing die to obtain a very simple final shape. However, neither of these apparatus are directed to the complex geometries associated with many of the cores produced by modern core box operations.

SUMMARY OF THE INVENTION

Accordingly, it is an object of this invention to facilitate the shaping of cores.

It is a further object of this invention to form and refine the shape of sand cores using a single apparatus.

A yet further object of this invention is to provide a method and apparatus for definning sand cores automatically upon removal of the cores from a core box.

In brief summary, this invention is directed to a core machine for forming a core. The machine includes a core box which defines an interior core cavity and is split across a seam into two halves such that the seam extends through the core cavity. The machine can hold the core box halves together or apart about the seam. A core shaping member having a central aperture with an outline that defines the periphery of the core at a location about the seam is also controlled by the machine. After formation of the core, the core box halves are separated and the shaping member is passed over the core prior to its removal from the core machine.

In another aspect, this invention is directed to a method of forming a core and refining its shape. The method starts by bringing first and second core box halves together to define a core cavity. The method continues by introducing core forming materials into the cavity and curing and solidifying the core materials, typically by catalytic or thermal means, to form a core. The core box halves are separated after curing and the core is retained in one of the core box halves. Following separation the core passes through a shaping member to refine its shape as it is ejected from the retaining core box half and removed from the machine.

By ejecting and removing the core through the shaping member additional finishing of the core at remote stations can be greatly reduced or eliminated altogether. Therefore, the apparatus and the method by which it is operated will increase the efficiency of forming cores by simplifying finishing operations, ultimately reducing the cost of the cores.

Other objects, embodiments and advantages of this invention will become apparent from the following detailed description.

DESCRIPTION OF THE PREFERRED EMBODIMENT

Figure 2:
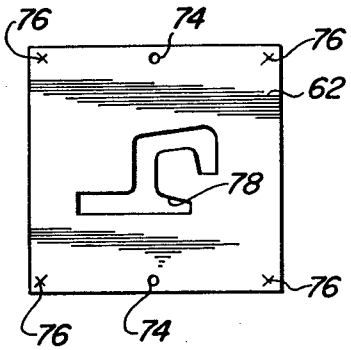
FIG. 2 is a plan view of a core defining plate.

The core machine of this invention is built about a frame including vertical members 10 and 12 which border a working area of the machine and provide support for machine components contained within and without the working area. Starting at the top of the working area and preceding downward, the core machine has a sand storage hopper 14 with a butterfly valve 16 arranged beneath it for admitting sand into a blow chamber 18 which is bounded on its lower end by a blow plate 20 having blow tubes 19 projecting upwardly therefrom. An upper half of a core box or cope 21 is positioned and supported below the blow plate by a series of cope lift pins 22. The underside of cope 21 has an open recess 23. Underneath the cope a lower half of the core box or drag 24, having a recess 25 open on its topside, is supported from a table 26. The height of the table is adjusted by a set of table lift cylinders 28 arranged about the periphery of the table. A set of cope lift cylinders 30 is arranged to the outside of the table cylinders and are used to adjust the height of the cope through the cope lift pins. A set of ejector cylinders 32 are grouped with the other cylinder sets and vertically adjust a set of ejector rods 34 which are part of an ejector assembly generally indicated as 36 and located in and about the drag. A shroud 38 houses a booster cylinder 40 and seals on area below the table to protect cylinder 40 from dirt and sand contamination.

Figure 1:
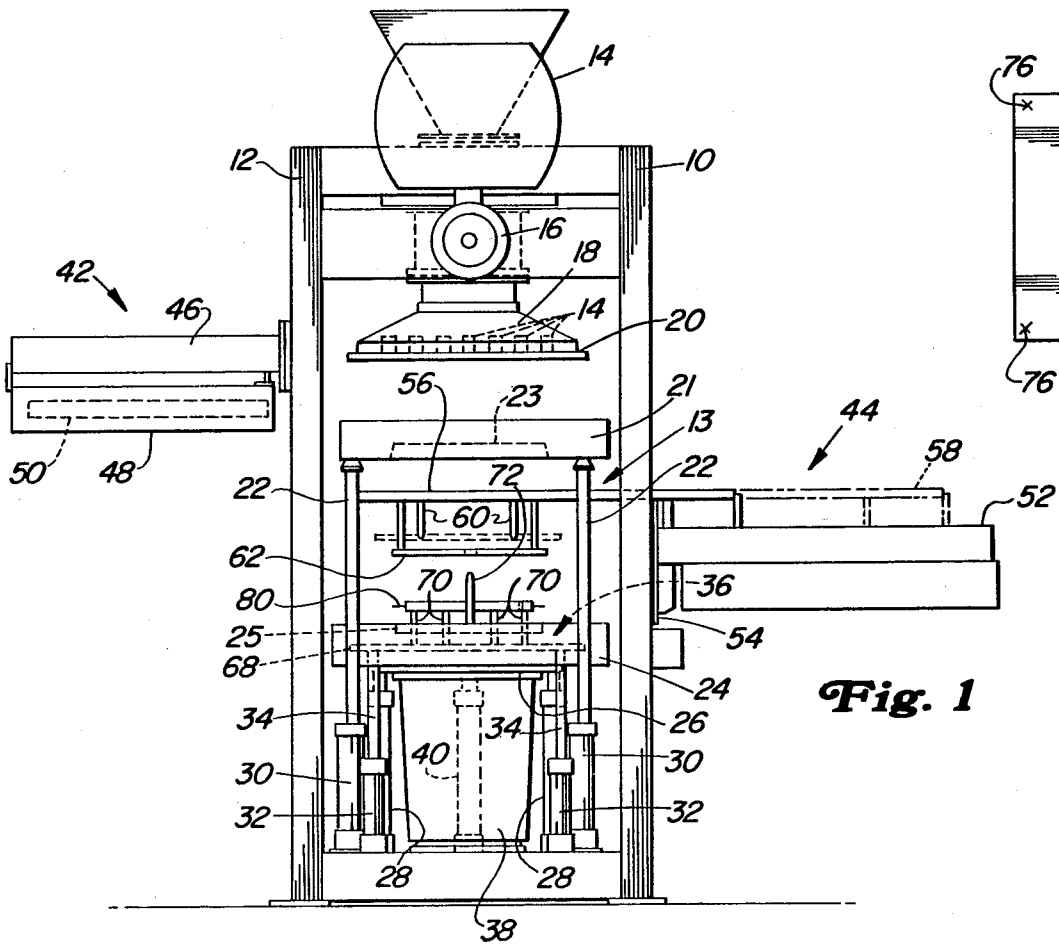
FIG. 1 is an elevation view of a core machine.

Looking to the outside of members 10 and 12 there are located a gassing manifold assembly 42 and a pick-off finger assembly 44. Gassing manifold assembly 42 is supported from member 12 by a beam 46 having a manifold guard 48 depending therefrom. A gassing manifold 50 is shown contained within the guard and can be shifted over into the frame area by an automatic slide mechanism (not shown). A rack beam 52, cantilevered from a set of vertical slide plates 54, provides support for pick-off finger assembly 44. One of slide plates 54 is attached to beam 52 and the other is attached to support member 10, with the plates cooperating to provide sliding support for rack beam 52 which prevents relative horizontal movement between beam 52 and support member 10 while allowing the pick-off finger assembly to be moved up or down by a hydraulic cylinder (not shown). A horizontally slidable assembly 56 rests at least partially on top rack beam 52 and is supported therefrom. The slidable assembly moves between an operating position within the working area as shown in FIG. 1 to a retracted position outside the working area indicated by dashed lines 58. A hydraulic cylinder (not shown) controls inward and outward movement of the slide assembly. A set of pick-off fingers 60 depends from the slide assembly for removing a finished or semi-finished core from the ejector pins. In this preferred embodiment a definning plate 62 also depends from the slide assembly 56 by a series of fin support rods 64.

Operation of the core machine forms, through a process hereinafter described, a core 66, that when first formed, is retained within drag recess 25. FIG. 1 depicts core 66 resting on a series of ejector pins 70 which, together with a pin support plate 68 from which the pins 70 project, and ejector rods 34, comprise ejector assembly 36. The ejector pin assembly ejects the core from the drag and holds the core above the drag on the tops of pins 70 for removal by the pick-off fingers 60. A set of guide pines 72 also project vertically from the drag and engage guide holes 74 see FIG. 2 on the definning plate 62 when the slide plate assembly is lowered in a machine cycle hereinafter described.

FIG. 2 shows a plan view of the definning plate 62. The definning plate has four points of support 76 at the four corners of the plate, to which rods 64 attach. Four guide holes 74 are located, about the edge of the plate, midway between opposing pairs of the support points 76 . An aperture 78 having an outline setting the final tolerance of core 66 along the line of separation between the cope and the drag is cut out of the center of the definning plate 62.

OPERATION

Use of the definning plate in the machine cycle of the core machine will now be described in the context of a complete machine cycle for forming a core and removing it form the core box machine. The core is formed by a process well known to those skilled in the art such as a cold box process wherein sand coated with binder precursors is blown into a core box and treated with a gaseous catalyst to form a removable sand core. The various steps described herein will take place automatically as part of a predetermined machine cycle.

The process begins by pressurizing the table lift cylinders 28, which pushes drag 24 upward against cope 21. Upper and lower faces of the drag and cope, respectively, are pushed together so that recesses 23 and 25 form a core cavity. The core box, composed of the cope and the drag, continuous upward by action of the table cylinders 28 until the top surface of cope 21 contacts blow plate 20. Extension of booster cylinder 40 at this time increases sealing pressure between the cope and the drag, and the cope and the blow plate. A series of sensors (not shown) indicate when the connection between the flow plate and the upper surface of the cope, and the connection between the lower surface of the cope and the upper surface of the drag are sufficiently tight to prevent any leakage.

A mixture of sand coated with phenolic and polyisocyanate resin, which was previously deposited in the blow chamber by a hereinafter descibed machine step, is blown out of the chamber by high pressure air and into the core box cavity. During the blow step butterfly valve 16 is closed to prevent back flow of air and said into hopper 14. Two to three seconds of blow time fills the cavity with sand.

Following the blow step, the booster cylinder 40 and the table cylinders 28 retract to lower the top of the cope a small distance from the flow plate. Gassing manifold 50 is then shuttled into the space between the blow plate and the top of the cope and the table cylinders 28 again extend to sandwich the gassing manifold tightly between the blow plate and the top of the cope. Booster cylinder 40 also extends to again increase the sealing pressure along the contact surfaces of the blow plate, gassing manifold, cope and drag.

In the next step, the addition of resin coated sand to the blow chamber and the addition of catalyst to the core box take place simultaneously. In order to form a binder for holding the sand together, a gaseous catalyst, in this case dimethylethylamine, passes into the gassing manifold, through a conduit and control system (not shown), which distributes the catalyst over the top surface of the cope and in turn throughout the resin coated sand contained within the core cavity. Gaseous catalyst passes through the sand and binder mixture for approximately eight to twenty seconds causing reaction of the phenolic resin with the polyisocyanate to form a relatively rigid urethane for solidying the sand into a core. The gassing manifold only has outlets on its lower side so that the catalyst flows only into the cope. While catalyst is entering the cope, butterfly valve 16 automatically opens and allows coated sand to flow from storage in hopper 14 to chamber 18. After a predetermined amount of sand has entered the chamber, valve 16 automatically closes. During the sand loading process the upper surface of gassing manifold 50 seals the blow tubes 19 by contact with the blow plate 20, thereby preventing any loss of sand from blow chamber 18. Once the sand has settled in the blow chamger, blow tubes 19 prevent sand from emptying out of the chamber when the area beneath blow plate 20 is open.

Following the gassing step and retraction of booster cylinder 40, the cover box is lowered by retraction of table cylinders 28. Continued retraction of the table cylinders 28 lowers the core box to a position where cope lift pins 22 contact the lower surface of cope 21 and hold the cope stationary with respect to the drag. Further retraction of the table cylinders 28 allows the drag to move downward and separate from the cope under its own weight. As the drag moves to a bottom position, ejector rods 34 contact ejector plate 68 so that the ejector pins 70 move upward relative to the drag. Relative upward movement of ejector pins 70 pushes core 66 out of drag recess 25. The timing of the ejector pin action in relation to drag movement and the elevation of the core above the drag is determined by the vertical position of ejector cylinders 32.

At this stage the ejector pins hold the core 66 above the drag and a thin fin of sand 80 extends horizontally around the core about the parting seam of the cope and drag. As the core sits on top the ejector pins, pick-off finger assembly 56 is axial shuttled in from a retracted position 58 into the working area of the core machine. Once located in the working space, the guide holes 74 on the definner plate are vertically aligned with respective guide pins 72 projecting from the drag. Pick-off finger assembly 44 is then lowered automatically to a point where guide pins 72 engage guide holes 74. Guide pin and hole engagment aligns the aperture of the definning plate with the core. Continued downward movement of the pick-off finger assembly causes the definning plate to pass over the core, shearing sand fin 80 from the core and giving the core a final dimensional tolerance about the outlet of the definning plate aperture. Once the definning plate passes below the core, pick-off fingers 60 grasp the sand core. When the pick-off fingers grasp the core, vertical movement of the pick-off finger assembly is reversed and the sand core rises with the pick-of fingers and defining plate to the level shown in FIG. 1. Outward shuttling of the pick-off finger assembly removes the sand core from the working area of the machine and into the area outside the support members. The sand core than is either picked up by hand or moved automatically to storage or a casting operation.

After removal of the core, table lift cylinder 28 can be extended to bring the the cope and drag together. This action will initiate restart of the cycle.

The description of this invention in the context of a specific embodiment is not meant to limit the scope of the invention to the details disclosed herein. In the way of an alternative it is also possible to design a machine that has the definner plate supported from the gassing manifold assembly and uses the shuttle mechanism of the gassing manifold to bring the definner plate into the work area of the core machine. This alternative represents only one of many variations that may be employed in practicing this invention.

We claim:

1. A machine for forming a core comprising:

a core box, defining an interior core cavity, made of first and second sections, said sections being joinable to form a seam and said seam having an interior border about said cavity;

a core shaping member defining an aperture, said aperture having an outline defining the shape of said core about said seam;

means for separating said sections and holding said sections together about said seam; and means for passing said core through the aperture of said member.

2. The invention of claim 1 , further comprising means for ejecting said core from one of said sections and removing said core from said machine.

3. The machine of claim 1 wherein said separation means moves said sections in relative opposite directions along an axis to effect separation and said passing means includes means for locating said member between said section and across said axis.

4. The machine of claim 3 wherein said machine has a set of fingers for grasping said core, said fingers being movable along said axis relative to said core, and said relative movement at least partially providing said means for passing said core through said aperture.

5. The machine of claim 1 wherein said apertures outline establishes the final tolerance for the core about said seam.

6. A machine for forming a core comprising:

a working area;

a core box, located in said working area, comprising first and second sections, said sections defining a core cavity and being separable about a transverse seam, said seam having an interior border about said cavity;

means for holding said sections together about said seam and holding said sections apart;

a core shaping member defining an aperture, said aperture having an outline defining the shape of said core about said seam;

an area outside said working area for storing said member when said sections are together;

means for moving said member into and out of said working area;

means for passing said core through the aperture of said member; and means for removing said core from said working area.

7. The core machine of claim 6 wherein said moving, passing and removing means includes a pick-off finger assembly for grasping the core after it has passed through said member.

8. The core machine of claim 7 wherein said aperture outline establishes the final tolerance for the core about said seam.

9. A core machine for forming a core comprising:

a core box divided into upper and lower sections, said sections defining an interior cavity and being separable about a transverse seam, said seam having a border about said cavity;

means for holding said sections together about said seam and holding said sections apart to define a space between said sections;

a core removal assembly having pick-off fingers for grasping said core and a definning plate; said definning plate having an aperture and said aperture having an outline defining the tolerance of said core about said seam;

a core ejector assembly for ejecting said core from the lower section having at least one contact member for contacting said core, pushing said core from said lower section by vertical movement relative thereto, and holding said core about said lower section; and means for moving said removal assembly into and out of said space;

means for passing said core through said definning plate aperture; and means for removing said core from said space.

10. A process for producing a core comprising the steps of:

sealing first and second sections of a core box about a common seam to form a cavity having the shape of said core;

introducing core forming materials into the cavity and soldifying the core forming materials to form said core;

separating said first and second sections and retaining said core in one section;

ejecting said core from the section retaining said core;

removing said core from between said sections; and positioning a core shaping member, having an aperture shaped to define the shape of said core about said seam, across the ejection and removal path of said core such that the shape of said core about said seam is conformed to the shape of said aperture while the core is ejected and removed from the core box.

* * * * *